US006808817B2

(12) United States Patent
Morelli et al.

(10) Patent No.: US 6,808,817 B2
(45) Date of Patent: Oct. 26, 2004

(54) KINETICALLY SPRAYED ALUMINUM METAL MATRIX COMPOSITES FOR THERMAL MANAGEMENT

(75) Inventors: Donald T. Morelli, White Lake, MI (US); Alaa A. Elmoursi, Troy, MI (US); Thomas H. Van Steenkiste, Ray, MI (US); Brian K. Fuller, Rochester Hills, MI (US); Bryan A. Gillispie, Warren, MI (US); Daniel W. Gorkiewicz, Washington, MI (US)

(73) Assignee: Delphi Technologies, Inc., Troy, MI (US)

( * ) Notice: Subject to any disclaimer, the term of this patent is extended or adjusted under 35 U.S.C. 154(b) by 211 days.

(21) Appl. No.: 10/098,800

(22) Filed: Mar. 15, 2002

(65) Prior Publication Data

US 2003/0175559 A1 Sep. 18, 2003

(51) Int. Cl.[7] ..... B32B 3/10; B32B 15/18; B32B 15/20; B05D 1/02; B05D 3/00

(52) U.S. Cl. ..... 428/469; 428/698; 428/702; 427/376.2; 427/421

(58) Field of Search ..... 428/469, 702, 428/698; 427/421, 376.2

(56) References Cited

U.S. PATENT DOCUMENTS

| | | | | |
|---|---|---|---|---|
| 3,100,724 A | | 8/1963 | Rocheville | |
| 3,993,411 A | | 11/1976 | Babcock et al. | |
| 4,263,335 A | | 4/1981 | Wagner et al. | |
| 4,606,495 A | | 8/1986 | Stewart, Jr. et al. | |
| 4,891,275 A | | 1/1990 | Knoll | |
| 4,939,022 A | | 7/1990 | Palanisamy | |
| 5,187,021 A | | 2/1993 | Vydra et al. | |
| 5,271,965 A | | 12/1993 | Browning | |
| 5,302,414 A | | 4/1994 | Alkhimov et al. | |
| 5,340,015 A | | 8/1994 | Hira et al. | |
| 5,395,679 A | | 3/1995 | Myers et al. | |
| 5,424,101 A | | 6/1995 | Atkins et al. | |
| 5,464,146 A | | 11/1995 | Zaluzec et al. | |
| 5,476,725 A | | 12/1995 | Papich et al. | |
| 5,527,627 A | | 6/1996 | Lautzenhiser et al. | |
| 5,533,257 A | * | 7/1996 | Romero et al. | 29/890.03 |
| 5,593,740 A | | 1/1997 | Strumbon et al. | |
| 5,746,267 A | * | 5/1998 | Yun et al. | 164/65 |
| 5,795,626 A | | 8/1998 | Gabel et al. | |
| 5,854,966 A | | 12/1998 | Kampe et al. | |
| 5,875,626 A | | 3/1999 | Cromartie | |
| 5,894,054 A | | 4/1999 | Poruchuri et al. | |
| 5,898,128 A | * | 4/1999 | Romero et al. | 174/52.1 |
| 5,907,761 A | | 5/1999 | Tohma et al. | |
| 5,952,056 A | | 9/1999 | Jordan et al. | |
| 5,989,310 A | | 11/1999 | Chu et al. | |
| 6,033,622 A | | 3/2000 | Maruyama | |
| 6,051,045 A | | 4/2000 | Narula et al. | |
| 6,051,277 A | | 4/2000 | Claussen et al. | |
| 6,074,737 A | | 6/2000 | Jordan et al. | |
| 6,129,135 A | * | 10/2000 | Divecha et al. | 164/97 |
| 6,129,948 A | | 10/2000 | Plummer et al. | |
| 6,139,913 A | | 10/2000 | Van Steenkiste et al. | |
| 6,283,386 B1 | | 9/2001 | Van Steenkiste et al. | |

OTHER PUBLICATIONS

Van Steenkiste, et al; *Kinetic Spray Coatings*; in Surface & Coatings Technology III; 1999; pp.62–71.

Liu, et al; *Recent Development in the Fabrication of Metal Matrix–Particulate Composites Using Powder Metallurgy Techniques*; in Journal of Material Science 29; 1994; pp. 1999–2007; National University of Singapore, Japan.

(List continued on next page.)

*Primary Examiner*—Deborah Jones
*Assistant Examiner*—Jason L Savage
(74) *Attorney, Agent, or Firm*—Scott A. McBain

(57) ABSTRACT

Disclosed is a method for forming a heat sink laminate and a heat sink laminate formed by the method. In the method a particle mixture is formed from a metal, an alloy or mixtures thereof with a ceramic or mixture of ceramics. The mixture is kinetically sprayed onto a first side of a dielectric material to form a metal matrix composite layer. The second side of the dielectric material is thermally coupled to a heat sink baseplate, thereby forming the heat sink laminate.

34 Claims, 5 Drawing Sheets

OTHER PUBLICATIONS

Papyrin; *The Cold Gas–Dynamic Spraying Method a New Method for Coatings Deposition Promises a New Generation of Technologies; Novosibirsk, Russia*.

McCune, al; Characterization of Copper and Steel Coatings Made by the Cold Gas–Dynamic Spray Method; National Thermal Spray Conference.

Alkimov, et al; *A Method of "Cold" Gas–Dynamic Deposition; Sov. Phys. Kokl. 36 Dec. 12, 1990; pp. 1047–1049*.

Dykuizen, et al; *Impact of High Velocity Cold Spray Particles*; in Journal of Thermal Spray Technology 8(4); 1999; pp. 559–564.

Swartz, et al; *Thermal Resistance At Interfaces*; Appl. Phys. Lett., vol. 51, No. 26,28; Dec. 1987; pp. 2201–2202.

Davis, et al; *Thermal Conductivity of Metal–Matrix Composlites; J. Appl. Phys. 77* (10), *May 15, 1995; pp. 4494–4960*.

Stoner et al; *Measurements of the Kapitza Conductance between Diamond and Several Metals*; Physical Review Letters, vol. 68, No. 10; Mar. 9, 1992; pp. 1563–1566.

Stoner et al; *Kapitza conductance and heat flow between solids at temperatures from 50 to 300K*; Physical Review B, vol. 48, No. 22, Dec. 1, 1993–II; pp. 16374;16387.

Johnson et al; *Diamond/AI metal matrix composites formed by the pressureless metal infiltration process*; J. Mater, Res., vol. 8, No. 5, May 1993; pp. 11691173.

Rajan et al; *Reinforcement coatings and interfaces in Aluminium Metal Matrix Composites*; pp. 3491–3503.

*LEC Manufacturing and Enginnering Capabilities*; Lanxide Electronic Components, Inc.

Dykhuizen et al; *Gas Dynamic Principles of Cold Spray*; Journal of Thermal Spray Technology; 06–98; pp. 205–212.

McCune et al; *An Exploration of the Cold Gas–Dynamic Spray Method For Several Materials Systems*.

Ibrahim et al; *Particulate Reinforced Metal Matrix Composites—A Review; Journal of Materials Science 26; pp. 1137–1156*.

* cited by examiner

KINETICALLY SPRAYED ALUMINUM METAL MATRIX COMPOSITES FOR THERMAL MANAGEMENT

TECHNICAL FIELD

The present invention is directed to a method for forming and applying metal matrix composites to substrates to form heat sinks. The applied composites are especially useful for thermal management of high power density electrical components such as silicon chips.

INCORPORATION BY REFERENCE

U.S. Pat. No. 6,139,913, "Kinetic Spray Coating Method and Apparatus," and U.S. Pat. No. 6,283,386 "Kinetic Spray Coating Apparatus" are incorporated by reference herein.

BACKGROUND OF THE INVENTION

During the past 20 years the utilization of computer chips has increased dramatically. With this progress has come a subsequent decrease in the size of the chips and an increase in the density of electrical circuits on a given chip. These high-density chips may have power densities as high as 10 $W/cm^2$. With the increase in power density of modern chips has come a concomitant increase in the need to thermally regulate the chips. These chips and other such high-density electrical components generate a tremendous amount of heat which must be dissipated to prevent damage to the chip.

Initially, the heat was dissipated by securing the chip to a heat sink material having high thermal conductivity. Examples of such materials include copper, aluminum, and diamond. One difficulty associated with such solutions is that typically the heat sink material has a much higher thermal expansion coefficient than the silicon chip. For example, the thermal expansion coefficient of silicon is 4 ppm $^\circ C^{-1}$ while the expansion coefficient of aluminum is 24 ppm $^\circ C^{-1}$. Thus, during thermal cycling of the system the aluminum will expand to a much greater extent than the silicon chip. This leads to debonding of the chip from the heat sink.

In an effort to address this difficulty the industry has developed metal matrix composites formed from ceramic preforms that have been infiltrated with molten metal under high temperature and often high pressure to create a metal matrix composite. The difficulty associated with this solution is that the metal matrix composites made in that manner are extremely costly to produce, can only be done with certain ceramic materials, and require inclusion of various compounds such as silicon in the infiltrating metal in order to prevent adverse reactions between the metal and the ceramic. Because the infiltration temperatures are generally in the range of 800° C. or higher reactions between the metal and the ceramic occur that lead to degradation in the thermal conductivity of the final metal matrix composite. The goal of these metal matrix composites is to produce a composite material that maintains the high thermal conductivity of the metallic element while adding the low thermal expansion coefficient of the ceramic to reduce differential expansion and contraction of the heat sink relative to the silicon chip.

In a typical construction of a silicon chip with an attached heat sink the first step is formation of the heat sink laminate. Then the laminate is attached to the silicon chip. The first laminate layer is generally a baseplate formed from a pure metal having a high thermal conductivity such as aluminum or copper that will be placed in the flow of a water stream or an air stream. The second layer is typically a metal matrix layer produced by high temperature infiltration of a molten metal into a ceramic preform and then secured to the baseplate. The third layer is some form of a dielectric material such as alumina, aluminum nitride, or beryllium oxide. The dielectric layer is necessary to provide electrical isolation between the silicon chip and the electrically conductive heat sink. Another metal matrix composite layer may be placed over the dielectric. Finally, another layer formed from copper or other solderable material is attached to the previous layer. Once this heat sink laminate is formed the silicon chip can be soldered to the last layer.

Because of the difficulties associated with current technology for forming metal matrix composites it would be advantageous to produce a metal matrix composite that did not require high temperatures during its production, that could be easily applied to a substrate surface, and that could be easily modified to provide different thermal conductivity and thermal expansion coefficients to the metal matrix composite so that it is optimized for the particular application. In addition, it would be advantageous to develop a system capable of forming metal matrix composites that are impossible to impractical to produce at the present time, such as for example, aluminum diamond metal matrix composites.

A new technique for producing coatings on a wide variety of substrate surfaces by kinetic spray, or cold gas dynamic spray, was recently reported in an article by T. H. Van Steenkiste et al., entitled "kinetic Spray Coatings," published in Surface and Coatings Technology, vol. 111, pages 62–71, Jan. 10, 1999. The article discusses producing continuous layer coatings having low porosity, high adhesion, low oxide content and low thermal stress. The article describes coatings being produced by entraining metal powders in an accelerated air stream, through a converging-diverging de Laval type nozzle and projecting them against a target substrate. The particles are accelerated in the high velocity air stream by the drag effect. The air used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must be high enough to exceed the yield stress of the particle to permit it to adhere when it strikes the substrate. It was found that the deposition efficiency of a given particle mixture was increased as the inlet air temperature was increased. Increasing the inlet air temperature decreases its density and thus increases its velocity. The velocity varies approximately as the square root of the inlet air temperature. The actual mechanism of bonding of the particles to the substrate surface is not fully known at this time. It is believed that the particles must exceed a critical velocity prior to their being able to bond to the substrate. The critical velocity is dependent on the material of the particle.

The work reported in the Van Steenkiste et al. article improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste article reported on work conducted by the National Center for Manufacturing Sciences (NCMS) to improve on the earlier Alkimov process and apparatus. Van Steenkiste et al. demonstrated that Alkimov's apparatus and process could be modified to produce kinetic spray coatings using particle sizes of greater than 50 microns and up to about 106 microns.

This modified process and apparatus for producing such larger particle size kinetic spray continuous layer coatings are disclosed in U.S. Pat. Nos. 6,139,913, and 6,283,386. The process and apparatus provide for heating a high pressure air flow up to about 650° C. and combining this with a flow of particles. The heated air and particles are directed through a de Laval-type nozzle to produce a particle exit velocity of between about 300 m/s (meters per second) to about 1000 m/s. The thus accelerated particles are directed toward and impact upon a target substrate with sufficient kinetic energy to impinge the particles to the surface of the substrate. The temperatures and pressures used are sufficiently lower than that necessary to cause particle melting or thermal softening of the selected particle. Therefore, no phase transition occurs in the particles prior to impingement.

The present invention relates to a kinetic spray method of forming metal matrix composites for use in heat sink laminates. The method is capable of quickly producing metal/ceramic composites that were not previously obtainable and applying them to substrates under very low thermal stress. The invention is particularly suitable for thermal management of silicon chips and other high power density electrical components.

SUMMARY OF THE INVENTION

In a first embodiment the present invention is a method of forming a heat sink laminate comprising the steps of: providing a layer of a dielectric material having a first side opposite a second side; entraining a particle mixture comprising at least one of a metal, an alloy or mixtures thereof and a ceramic or mixture of ceramics into a flow of a gas, the gas at a temperature insufficient to cause thermal softening of the particle mixture; directing the particle mixture entrained in the flow of gas through a supersonic nozzle placed opposite the first side of the dielectric material and accelerating the particle mixture to a velocity sufficient to result in adherence of the particle mixture onto the first side of the dielectric material and thereby forming a metal matrix composite layer on the first side of the dielectric material; and thermally coupling the second side of the dielectric material to a heat sink baseplate, thereby forming the heat sink laminate.

In a second embodiment the present invention is heat sink laminate comprising a kinetically sprayed metal matrix composite layer on a first side of a dielectric material and a heat sink baseplate thermally coupled to a second side of the dielectric material, the second side opposite the first side.

DESCRIPTION OF THE PREFERRED EMBODIMENT

The present invention comprises a method for formation of metal matrix composites and their use in heat sink laminates. The method includes use of a kinetic spray process as generally described in U.S. Pat. Nos. 6,139,913, 6,283,386 and the article by Van Steenkiste, et al. entitled "kinetic Spray Coatings" published in Surface and Coatings Technology Volume III, Pages 62–72, Jan. 10, 1999, all of which are herein incorporated by reference.

Figure 1:
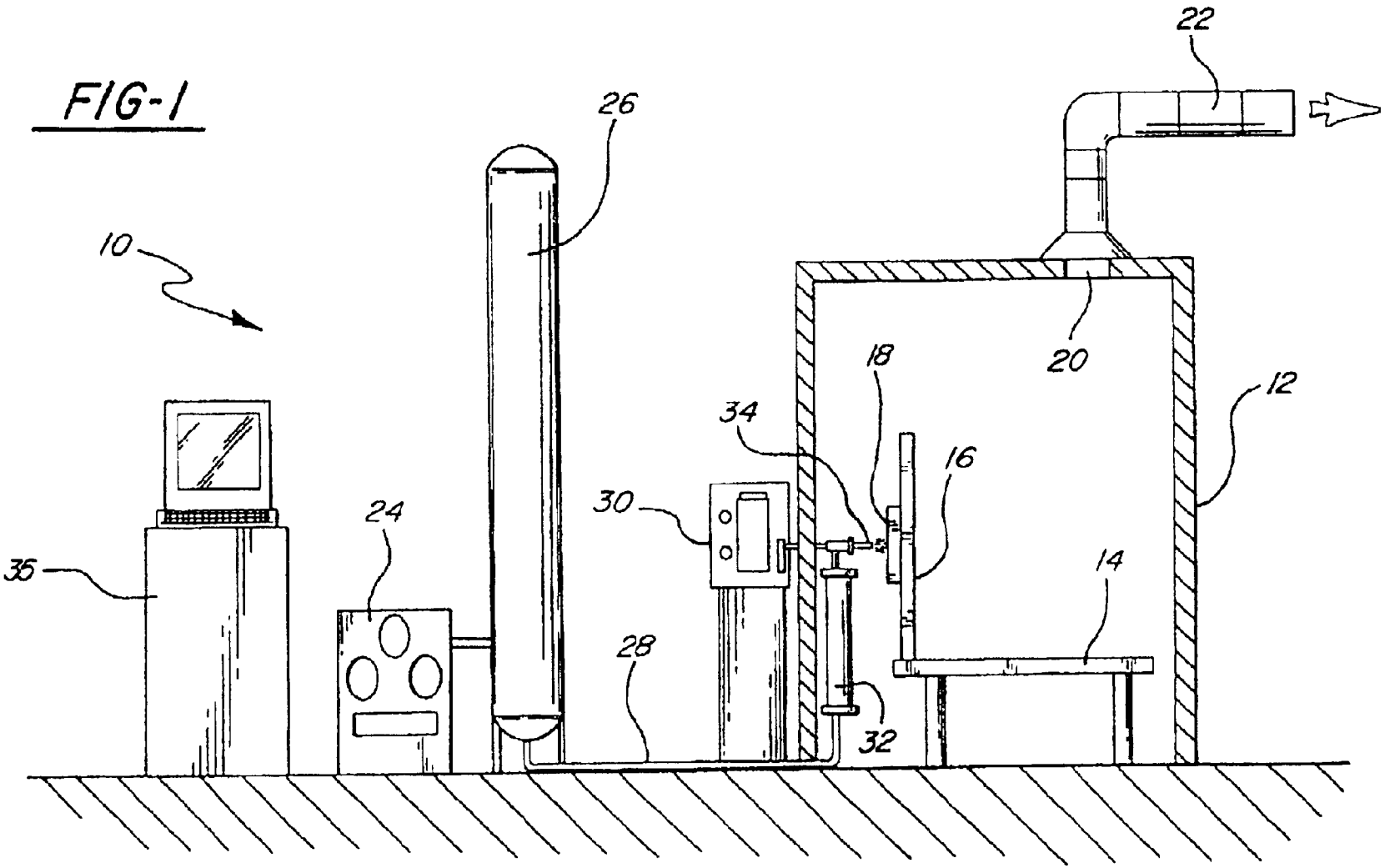
FIG. 1 is a generally schematic layout illustrating a kinetic spray system for performing the method of the present invention.

Referring first to FIG. 1, a kinetic spray system for use according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable substrate material to be coated. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a high pressure powder feeder 30 and a separate air heater 32. The air heater 32 supplies high pressure heated air, the main gas described below, to a kinetic spray nozzle 34. The temperature of the main gas varies from 100 to 3000° C., depending on the powder or powders being sprayed. The pressure of the main gas and the powder feeder varies from 200 to 500 psi. The powder feeder 30 mixes particles of a powder or a powder mixture of particles with unheated high-pressure air and supplies the mixture to a supplemental inlet line 48 of the nozzle 34. The particles are described below and may comprise a metal, an alloy, a ceramic, a polymer, or mixtures thereof. A computer control 35 operates to control both the pressure of air supplied to the air heater 32 and the temperature of the heated main gas exiting the air heater 32. As would be understood by one of ordinary skill in the art, the system 10 can include multiple powder feeders 30, all of which are connected to supplemental feedline 48. For clarity only one powder feeder 30 is shown in FIG. 1. Having multiple powder feeders 30 allows one to rapidly switch between spraying one particle population to spraying a multiple of particle populations. Thus, an operator can form zones of two or more types of particles that smoothly transition to a single particle type and back again.

Figure 2:
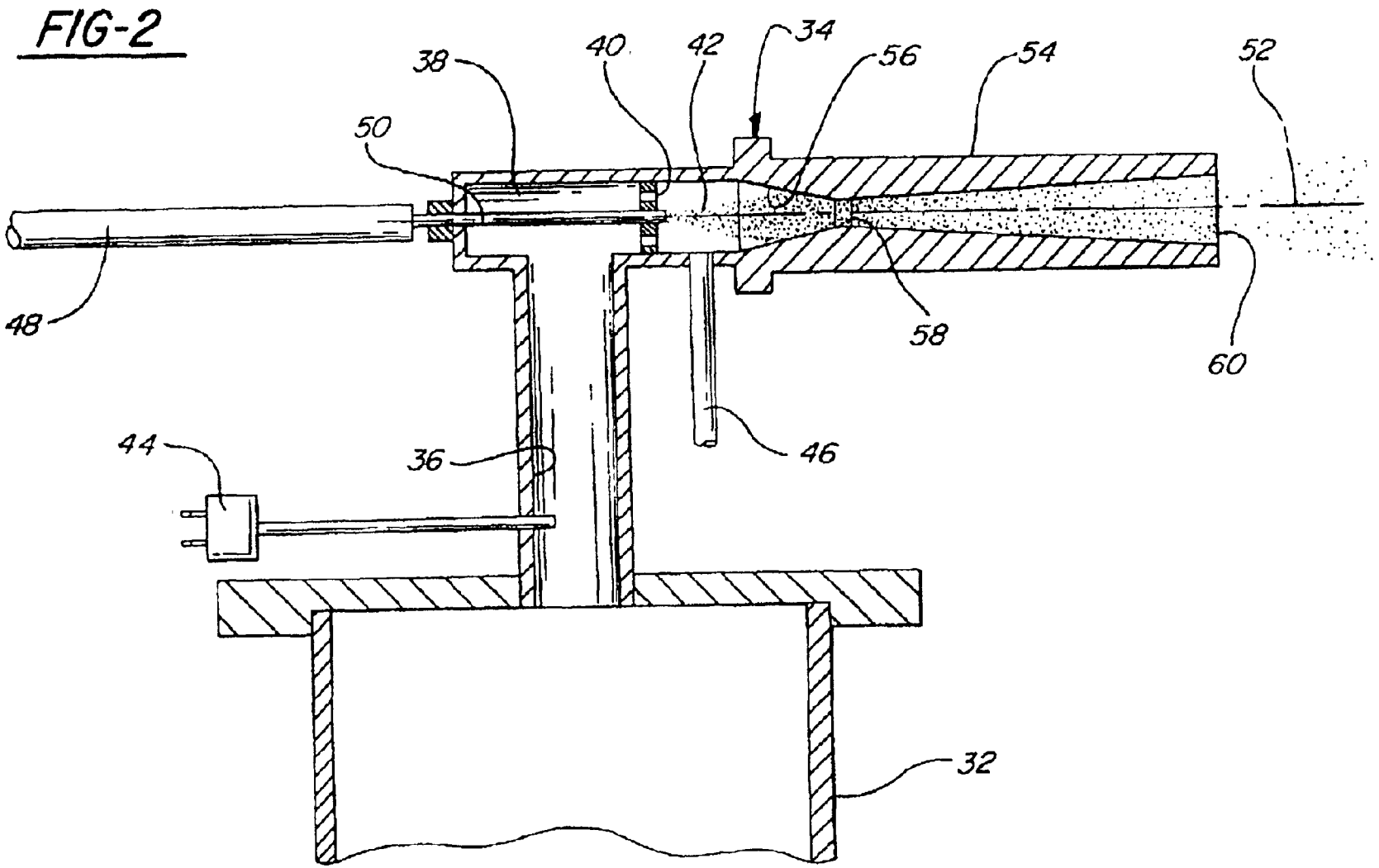
FIG. 2 is an enlarged cross-sectional view of a kinetic spray nozzle used in the system.

FIG. 2 is a cross-sectional view of the nozzle 34 and its connections to the air heater 32 and the supplemental inlet line 48. A main air passage 36 connects the air heater 32 to the nozzle 34. Passage 36 connects with a premix chamber 38 which directs air through a flow straightener 40 and into a mixing chamber 42. Temperature and pressure of the air or other heated main gas are monitored by a gas inlet temperature thermocouple 44 in the passage 36 and a pressure sensor 46 connected to the mixing chamber 42.

The mixture of unheated high pressure air and coating powder is fed through the supplemental inlet line 48 to a powder injector tube 50 comprising a straight pipe having a predetermined inner diameter. The predetermined diameter can range from 0.40 to 3.00 millimeters. Preferably it ranges from 0.40 to 0.90 millimeters in diameter. The tube 50 has a central axis 52 which is preferentially the same as the axis of the premix chamber 38. The tube 50 extends through the premix chamber 38 and the flow straightener 40 into the mixing chamber 42.

Mixing chamber 42 is in communication with the de Laval type nozzle 54. The nozzle 54 has an entrance cone 56 that decreases in diameter to a throat 58. Downstream of the throat is an exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The portion of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters. The distance from the throat 58 to the exit end 60 may vary from 60 to 400 millimeters.

As disclosed in U.S. Pat. Nos. 6,139,913 and 6,283,386 the powder injector tube 50 supplies a particle powder mixture to the system 10 under a pressure in excess of the pressure of the heated main gas from the passage 36. The nozzle 54 produces an exit velocity of the entrained particles of from 300 meters per second to as high as 1200 meters per second. The entrained particles gain kinetic and thermal energy during their flow through this nozzle. It will be recognized by those of skill in the art that the temperature of the particles in the gas stream will vary depending on the particle size and the main gas temperature. The main gas temperature is defined as the temperature of heated high-pressure gas at the inlet to the nozzle 54. These temperatures and the exposure time of the particles are kept low enough that the particles are always at a temperature below their melting temperature so even upon impact, there is no change in the solid phase of the original particles due to transfer of kinetic and thermal energy, and therefore no change in their original physical properties. The particles exiting the nozzle 54 are directed toward a surface of a substrate to coat it.

Upon striking a substrate opposite the nozzle 54 the particles flatten into a nub-like structure with an aspect ratio of generally about 5 to 1. When the substrate is a metal and the particles include a metal, all the particles striking the substrate surface fracture the oxidation on the surface layer and the metal particles subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate it is necessary that it reach or exceed its critical velocity which is defined as the velocity where at it will adhere to a substrate when it strikes the substrate after exiting the nozzle 54. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate.

The kinetic spray system 10 is extremely versatile in producing any of a variety of coatings. Utilizing a system 10 that includes a plurality of powder feeders 30 enables one to produce an endless variety of mixes of particles exiting the nozzle 54 to coat a substrate. The system 10 permits one to create coatings that initially are composed of a plurality of components and then as the coating layer is built up supply of one or more of the particles may be stopped thus enabling the coating to transition to a different composition from that initially coated on the substrate. Typically, the size of particles utilized in the powder feeders 30 ranges from 1 to 110 microns. Utilizing the system 10 it is now possible to produce metal matrix compositions that previously were only possible utilizing the above-mentioned method of infiltrating a molten metal into a preformed ceramic. The system 10 has been utilized to produce metal matrix compositions that comprise one or more metals or alloys in combination with one or more ceramics. Metals that have been utilized include aluminum, copper, tin alloys, steel alloys and other alloys. The ceramics that have been utilized include diamond, silicon carbide, and aluminum nitride. As would be understood by one of ordinary skill in the art, however, other metals, alloys, and ceramic materials can be utilized to form the subject metal matrix composites.

The coatings produced utilizing the present method have thermal conductivities that are nearly equal to or in some cases exceed that of the pure metal utilized to form the metal matrix composition. In addition, these composite coatings have a thermal coefficient of expansion that is much lower than the pure metal and closer to that of silicon. Therefore, the coatings of the present invention will reduce the damage caused by thermal cycling of the silicon component. Also, since the particles are never melted the process also dramatically reduces the thermal stress that occurs in applying the coating relative to previous metal matrix compositions. In addition, the overall temperature during formation of the metal matrix compositions of the present invention is much lower than that utilized during the prior art metal matrix compositions formed by infiltration of a molten metal into a ceramic preform. Therefore, the metal matrix compositions of the present invention do not permit reactions between the metal and the ceramic of the metal matrix composition.

The present invention can be utilized to coat any of a large variety of heat sink laminate substrates including substrates that are formed from several microns to several centimeters in thickness. Typically, the amount of ceramic in the mixture of metal and ceramic used to form the metal matrix composition ranges from 30 to 70% by weight based on the total weight of the mixture. The main gas temperature that is utilized for accelerating the particles in the present invention can vary from 100° C. to approximately 1700° C. The main gas temperature utilized depends on the identity of the metal or alloy utilized to form the metal matrix composition.

EXAMPLE 1

Using the system 10 as described above, a series of metal matrix composite coatings were produced and their thermal conductivity before and after a post-coating heat treatment were measured. The starting powder material comprised: 100% aluminum: a 50% by weight aluminum to 50% by weight silicon carbide mixture; or a 50% by weight aluminum to 50% by weight diamond mixture. These particle mixtures were then sprayed through the system 10 at a temperature of approximately 500° C. at pressures of from 300 to 350 psi. The mixtures were sprayed onto an aluminum substrate to form a 5 to 20 millimeter thick metal matrix composition coating. A portion of the coated substrates were subjected to a post-coating treatment of heating to 550° C. in air for approximately one hour. The thermal conductivity of all of the coatings was then measured both before and after the heat treatment. The results of these experiments are presented in Table 1 below.

TABLE 1

| Starting Composition | Measured Volume Fraction of Ceramic (%) | Measured Density (% Theoretical) | Measured Thermal Conductivity, as-Sprayed ($Wm^{-1\circ}$ $C.^{-1}$) | Measured Thermal Conductivity, Post-550° C. Heat Treatment ($Wm^{-1\circ}$ $C.^{-1}$) |
|---|---|---|---|---|
| 100% aluminum | 0 | 90–95 | 114 | 168 |
| 50% aluminum/ 50% silicon carbide | 30 | 85–90 | 129 | 159 |
| 50% aluminum/ 50% diamond | 28 | 85–90 | 100 | 191 |

It can be seen from the data that the system 10 is capable of producing metal matrix composite coatings that have thermal conductivities as good as or even better than that of the pure aluminum metal used to form the matrix. In addition, the thermal conductivity of the coatings can be increased by heat treatment in air. It is also possible to use any inert gas as the atmosphere during the heat treatment. It is not necessary that the heat treatment occur for all coatings of the present invention but it can be useful depending on the identity of the metal matrix composite. In addition, it can be seen from Table 1 that for aluminum/diamond and aluminum/silicon carbide coatings the heat treatment step post-coating is advantageous.

Figure 3:
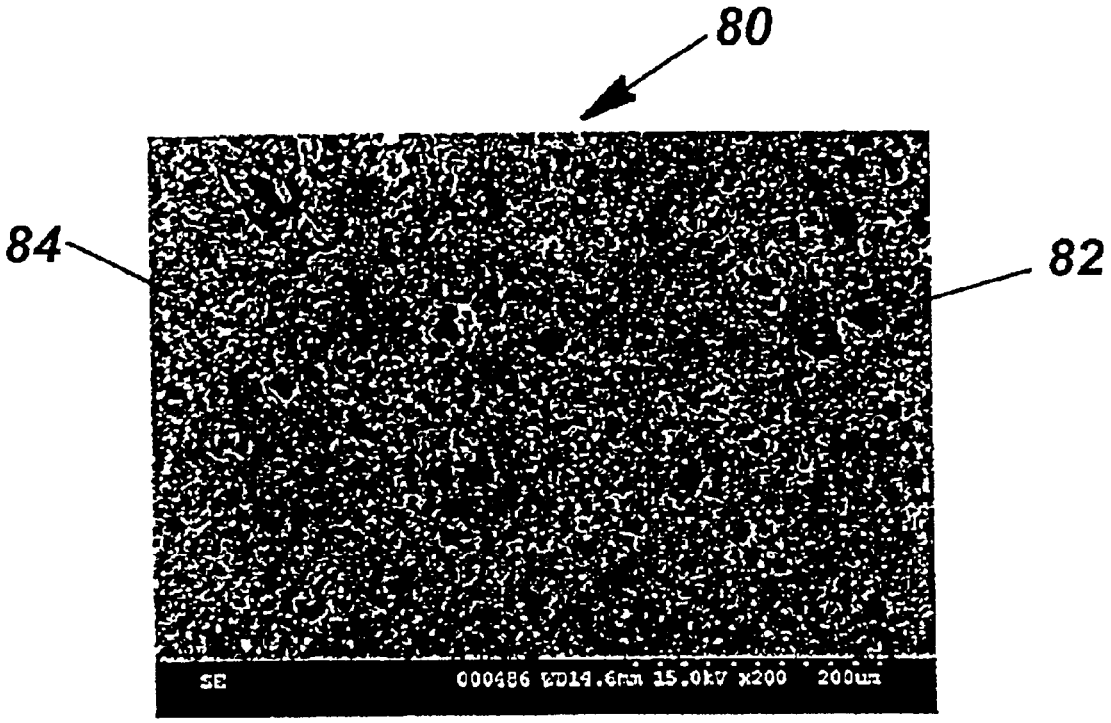
FIG. 3 is a scanning electron micrograph of an Aluminum diamond composite deposited according to the present invention.

In FIG. 3 a scanning electron micrograph of an aluminum diamond metal matrix composite deposit according to the present invention is shown generally at 80. The dark regions 82 are diamond particles and the lighter regions 84 are the aluminum particles. The distribution of diamond particles throughout the aluminum layer is rather uniform.

Figure 4:
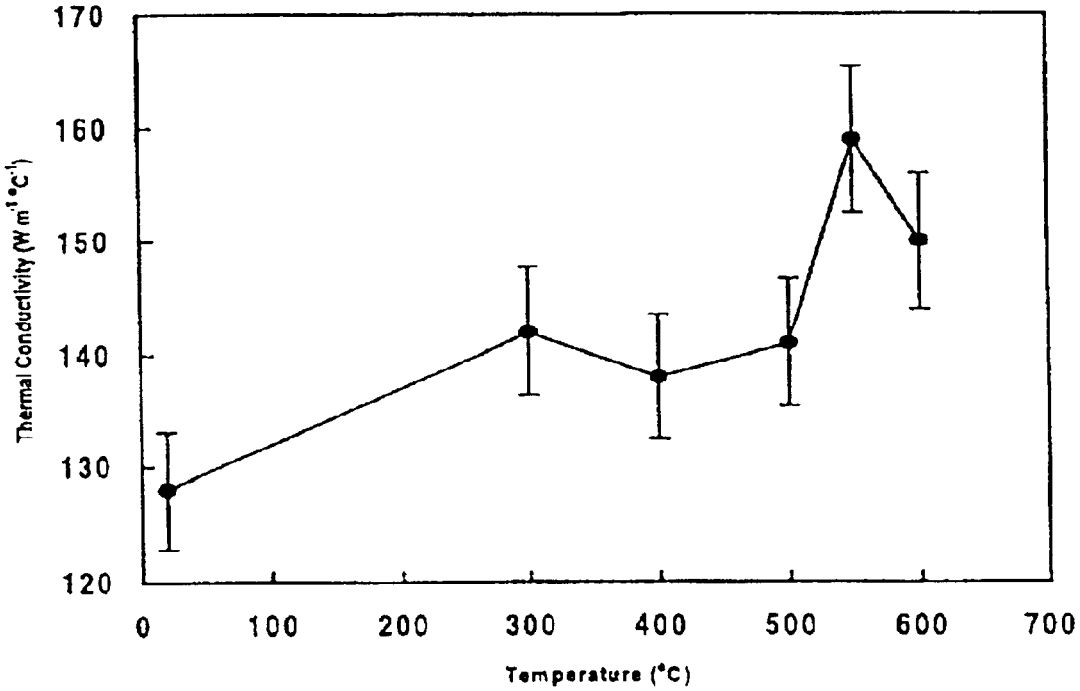
FIG. 4 is a graph illustrating the effect of post-deposit heat treatment on the thermal conductivity of an aluminum/silicon carbide metal matrix composite deposited according to the present invention.

A graph of the effect of the post-coating heat treatment temperature on the thermal conductivity of an aluminum silicon carbide metal matrix composite deposited according to the present invention is shown in FIG. 4. The results show in FIG. 4 were obtained after a one hour treatment of the aluminum silicon carbide metal matrix composite at the indicated temperature. The results in FIG. 4 demonstrate a peak in the increase in thermal conductivity following heat treatment at 550° C. The affect of heat treatment on the thermal conductivity varies by the composition of the metal matrix composite and some metal matrix composites may not be positively affected by a post-coating heat treatment.

Figure 5:
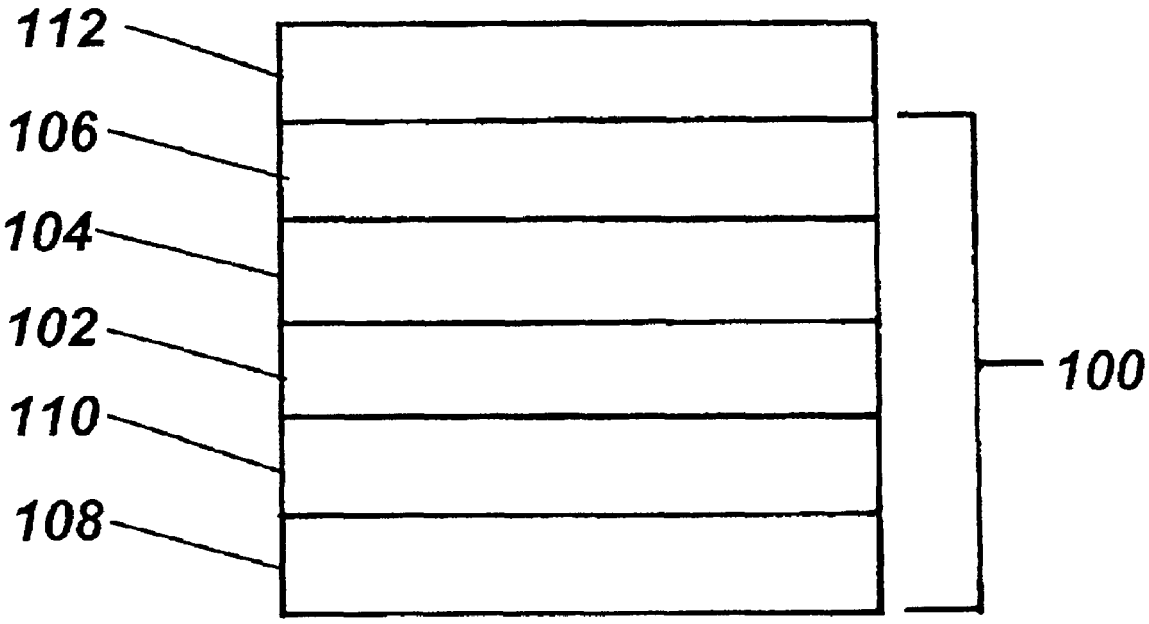
FIG. 5 is a schematic drawing of a heat sink laminate prepared according to the present invention secured to a chip.

In FIG. 5, a heat sink laminate in accordance with the present invention is shown generally at 100 attached to a silicon chip 112. In one embodiment of the method of the present invention one initially begins with a layer of a dielectric material 102 such as, for example, alumina, aluminum nitride, or beryllium oxide. Other dielectric materials are known to those of ordinary skill in the art and can be used in the present invention. The dielectric layer 102 generally has a thickness ranging from $^{3}/_{1000}$ to $^{40}/_{1000}$ of an inch.

A metal matrix composite formed according to the present invention is kinetic spray coated onto a first side of the dielectric material 102 to form a metal matrix composite layer 104. As discussed above, the metal matrix composite is formed by combining particles of a metal, an alloy, or mixtures thereof with particles of one or more ceramics such as diamond, silicon carbide, or aluminum nitride and then spraying the particles through the kinetic spray system 10. Other metals could be utilized such as copper, tin, or steel. Generally, the metal matrix composite layer 104 has a thickness of from 0.5 to 4.0 millimeters. The ratio of metal or alloy to ceramic is selected to provide the desired thermal conductivity and thermal expansion coefficient that is appropriate for the application. The present invention permits one to tailor the metal matrix composite to produce a layer with the desired thermal conductivity and coefficient of expansion.

Then an attachment layer 106 formed from a metal or an alloy is applied to the metal matrix composite layer 104. In one embodiment the attachment layer 106 is applied by the kinetic spray system 10 either by stopping the feed of the ceramic particles while continuing to feed the metal or alloy used to form the metal matrix composite layer 104 or in a separate coating step using the system 10 and only a metal or alloy particle feed. Alternately other coating methods know to those of ordinary skill in the art can be used to apply the attachment layer 106.

The next step can vary, in one embodiment a second side of the dielectric material 102 opposite the first side is directly attached to a heat sink baseplate 108 formed from a material such as a pure metal of, for example, aluminum, copper, or other metal having a high thermal conductivity. Alternatively, and as an option, a second metal matrix composite layer 110 can be kinetically sprayed onto the second side of the dielectric material 102 and then the second metal matrix composite layer 110 can be attached to the baseplate 108. As would be understood by one of ordinary skill in the art these steps could be performed in a different order without departing from the invention. For example, one could begin with the baseplate 108 and work up to the attachment layer 106.

At this point the laminate 100 can be treated with a post-coating heat treatment under air or an inert gas atmosphere as described above to increase the thermal conductivity of the metal matrix composite layers 104, 110 or layer 104. Finally, the silicon chip 112 is secured to the attachment layer 106, generally by soldering it to attachment layer 106, however any suitable attachment method can be used.

While the preferred embodiment of the present invention has been described so as to enable one skilled in the art to practice the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A method of forming a heat sink laminate comprising the steps of:

a) providing a layer of a dielectric material having a first side opposite a second side;

b) entraining a particle mixture comprising at least one of a metal, an alloy or mixtures thereof and a ceramic or mixture of ceramics into a flow of a gas, the gas at a temperature insufficient to cause thermal softening of the particle mixture;

c) directing the particle mixture entrained in the flow of gas through a supersonic nozzle placed opposite the first side of the dielectric material and accelerating the particle mixture to a velocity sufficient to result in adherence of the particle mixture onto the first side of the dielectric material and thereby forming a metal matrix composite layer on the first side of the dielectric material; and d) thermally coupling the second side of the dielectric material to a heat sink baseplate, thereby forming the heat sink laminate.

2. The method of claim 1, wherein step a) comprises providing a layer comprising alumina, aluminum nitride, beryllium oxide or a mixture thereof.

3. The method of claim 1, wherein step a) further comprises providing a layer of a dielectric material having a thickness of from 3/1000 to 40/1000 of an inch.

4. The method of claim 1, wherein step b) comprises entraining a particle mixture comprising at least one of aluminum, copper, tin, an alloy or mixtures thereof and a ceramic or mixture of ceramics into the flow of the gas.

5. The method of claim 1, wherein step b) comprises entraining a particle mixture comprising at least one of a metal, an alloy or mixtures thereof and a ceramic comprising diamond, aluminum nitride, silicon carbide, or mixtures thereof into the flow of the gas.

6. The method of claim 1, wherein step b) comprises entraining a particle mixture having particles with a nominal average diameter of from 50 to 106 microns and comprising at least one of a metal, an alloy or mixtures thereof and a ceramic or mixture of ceramics into the flow of the gas.

7. The method of claim 1, wherein step b) comprises entraining a particle mixture comprising at least one of a metal, an alloy or mixtures thereof and a ceramic or mixture of ceramics into a flow of a gas, the gas at a temperature of from 100 to 1700 degrees Celsius.

8. The method of claim 1, wherein step b) comprises entraining a particle mixture comprising from 70 to 30 percent by weight based on the total weight of the mixture of at least one of a metal, an alloy or mixtures thereof and from 30 to 70 percent by weight based on the total weight of the mixture of a ceramic or mixture of ceramics into the flow of the gas.

9. The method of claim 1, wherein step c) comprises accelerating the particle mixture to a velocity of from 300 to 1200 meters per second.

10. The method of claim 1, wherein step c) comprises forming a metal matrix composite layer having a thickness of from 0.5 to 4.0 millimeters.

11. The method of claim 1, wherein step d) comprises attaching the heat sink baseplate directly to the second side of the dielectric material.

12. The method of claim 1, wherein step d) further comprises entraining a particle mixture comprising a metal, an alloy or mixtures thereof and a ceramic or mixture of ceramics into a flow of a gas, the gas at a temperature insufficient to cause thermal softening of the particle mixture;

directing the particle mixture entrained in the flow of gas through a supersonic nozzle placed opposite one of the second side of the dielectric material or the heat sink baseplate and accelerating the particle mixture to a velocity sufficient to result in adherence of the particle mixture onto either the second side of the dielectric material or the baseplate, thereby forming a second metal matrix composite layer; and then directly attaching the other of the second side of the dielectric material or the baseplate to the second metal matrix composite layer.

13. The method of claim 1, comprising the further step of providing an attachment layer on the metal matrix composite layer.

14. The method of claim 13, further comprising entraining a particle mixture comprising a metal, an alloy or mixtures thereof into a flow of a gas, the gas at a temperature insufficient to cause thermal softening of the particle mixture;

directing the particle mixture entrained in the flow of gas through a supersonic nozzle placed opposite the metal matrix composite layer and accelerating the particle mixture to a velocity sufficient to result in adherence of the particle mixture onto the metal matrix composite layer, thereby forming the attachment layer.

15. The method of claim 13, comprising the further step of securing a silicon chip to the attachment layer.

16. The method of claim 15, comprising soldering the silicon chip to the attachment layer.

17. The method of claim 1, comprising the further step of maintaining the heat sink laminate at a temperature of at least 100 degrees Celsius in an atmosphere comprising air, an inert gas, or mixtures thereof for a period of time sufficient to increase the thermal conductivity of the heat sink laminate.

18. The method of claim 17, comprising maintaining the heat sink laminate in an argon atmosphere.

19. The method of claim 17, comprising maintaining the heat sink laminate at a temperature of at least 100 degrees Celsius for a period of time from 1 to 6 hours.

20. A heat sink laminate comprising a kinetically sprayed metal matrix composite layer on a first side of a dielectric material and a heat sink baseplate thermally coupled to a second side of said dielectric material, said second side opposite said first side.

21. The heat sink laminate of claim 20, wherein said metal matrix composite layer comprises a metal, an alloy, or mixtures thereof and a ceramic or mixture of ceramics.

22. The heat sink laminate of claim 20, wherein said metal matrix composite layer comprises from 80 to 30 percent by weight of least one of a metal, an alloy or mixtures thereof and from 20 to 70 percent by weight of a ceramic or mixture of ceramics.

23. The heat sink laminate of claim 20, wherein said metal matrix composite layer is from 0.5 to 4.0 millimeters thick.

24. The heat sink laminate of claim 20, wherein said metal matrix composite layer comprises aluminum, copper, tin, steel, or mixtures thereof.

25. The heat sink laminate of claim 20, wherein said metal matrix composite layer comprises diamond, aluminum nitride, silicon carbide, and mixtures thereof.

26. The heat sink laminate of claim 20, wherein said dielectric material comprises alumina, aluminum nitride, beryllium oxide, or mixtures thereof.

27. The heat sink laminate of claim 20, wherein said dielectric material has a thickness of from 3/1000 to 40/1000 of an inch.

28. The heat sink laminate of claim 20, further comprising an attachment layer on said metal matrix composite layer.

29. The heat sink laminate of claim 28, wherein said attachment layer comprises a metal, an alloy, or a mixture thereof.

30. The heat sink laminate of claim 29, wherein said attachment layer comprises a metal, an alloy, or a mixture thereof kinetically sprayed onto said metal matrix composite layer.

31. The heat sink laminate of claim 28, further comprising a silicon chip secured to said attachment layer.

32. The heat sink laminate of claim 31, comprising said silicon chip soldered to said attachment layer.

33. The heat sink laminate of claim 20, wherein said heat sink baseplate is directly attached to said second side of said dielectric material.

34. The heat sink laminate of claim 20, further comprising a second metal matrix composite layer kinetically sprayed onto one of said second side of said dielectric material or said heat sink baseplate and attached to the other of said second side of said dielectric material or said heat sink baseplate.

* * * * *